US008128762B2

(12) United States Patent
Watanabe

(10) Patent No.: US 8,128,762 B2
(45) Date of Patent: Mar. 6, 2012

(54) HIGH-STRENGTH STEEL SHEET SUPERIOR IN FORMABILITY

(75) Inventor: Seiko Watanabe, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 324 days.

(21) Appl. No.: 12/498,712

(22) Filed: Jul. 7, 2009

(65) Prior Publication Data

US 2010/0037995 A1 Feb. 18, 2010

(30) Foreign Application Priority Data

Aug. 12, 2008 (JP) ..... 2008-208019

(51) Int. Cl.

| | |
|---|---|
| ***C22C 38/14*** | (2006.01) |
| ***C22C 38/12*** | (2006.01) |
| ***C22C 38/32*** | (2006.01) |
| ***C22C 38/44*** | (2006.01) |
| ***C21D 8/00*** | (2006.01) |

(52) U.S. Cl. ..... 148/320; 148/333; 148/334; 148/330; 148/651; 148/652; 148/533

(58) Field of Classification Search ..... 148/320, 148/333, 334, 533, 330, 651, 652
See application file for complete search history.

(56) References Cited

U.S. PATENT DOCUMENTS

| | | | | |
|---|---|---|---|---|
| 6,692,584 | B2 * | 2/2004 | Sakata et al. | 148/320 |
| 2003/0188811 | A1 * | 10/2003 | Kami et al. | 148/603 |
| 2003/0201039 | A1 * | 10/2003 | Mochida et al. | 148/651 |
| 2004/0074575 | A1 | 4/2004 | Kashima et al. | |

FOREIGN PATENT DOCUMENTS

| | | | |
|---|---|---|---|
| CN | 1296507 | C | 1/2007 |
| EP | 1 201 780 | A1 | 5/2002 |
| EP | 1 350 859 | | 10/2003 |
| EP | 1 514 951 | A1 | 3/2005 |
| EP | 1 826 287 | A2 | 8/2007 |
| EP | 1 865 085 | A1 | 12/2007 |
| JP | 2003-171736 | | 6/2003 |
| JP | 2003-193188 | | 7/2003 |
| JP | 2004-211126 | | 7/2004 |
| JP | 2005-146301 | | 6/2005 |
| JP | 2006-342373 | | 12/2006 |
| JP | 2007-9317 | | 1/2007 |
| KR | 10-0711468 | | 4/2007 |
| KR | 10-0711476 | | 4/2007 |
| WO | WO 2005/113848 | A1 | 12/2005 |

* cited by examiner

*Primary Examiner* — Deborah Yee
(74) *Attorney, Agent, or Firm* — Oblon, Spivak, McClelland, Maier & Neustadt, L.L.P.

(57) ABSTRACT

Disclosed is a high-strength steel sheet which has a predetermined component composition, structurally has a ferrite matrix structure and bainitic and martensitic second phase structures, and has a ferrite fraction of from 50 to 86 percent by area, a bainite fraction of from 10 to 30 percent by area, and a martensite fraction of from 4 to 20 percent by area, relative to the entire structure, in which the bainite area fraction is larger than the martensite area fraction, the ferrite has an average grain size of 2.0 to 5.0 μm, and the ratio of the average ferrite hardness (Hv) to the tensile strength (MPa) of the steel sheet is equal to or more than 0.25. The steel sheet excels both in TS-EL balance and TS-λ balance at high strengths on the order of 590 to 780 MPa.

7 Claims, 1 Drawing Sheet

HIGH-STRENGTH STEEL SHEET SUPERIOR IN FORMABILITY

FIELD OF THE INVENTION

The present invention relates to high-strength steel sheets that have a tensile strength on the order of 590 to 780 MPa and have improved formability (workability) such as elongation and stretch flange formability. High-strength steel sheets according to the present invention are useful as high-strength steel sheets used as materials for galvanized steel sheets and galvannealed steel sheets and are advantageously usable typically in automobile structural members requiring high formability and members for household appliances. The automobile structural members include body skeleton members such as pillars, members, and reinforcing members; and strengthening members such as bumpers, door guard bars, sheet components, and suspension components.

BACKGROUND OF THE INVENTION

Members used typically in automobiles are required to have not only high strength and high ductility (elongation) but also superior stretch flange formability from the viewpoints of ensuring collision safety and being environmentally friendly (increasing fuel efficiency). Specifically, demands have been made to provide high-strength steel sheets excellent both in balance between strength and elongation (hereinafter also referred to as "TS-EL balance" or "TS×EL") and balance between strength and stretch flange formability (hereinafter also referred to as "TS-λ balance" or "TS×λ"). These balances are indices for formability.

Multi-phase structure steel sheets are known as high-strength steel sheets excellent in formability. The multi-phase structure steel sheets contain a ferrite matrix (main phase) and a second phase structure including austenitic low-temperature transformation phases such as martensite and bainite. The second phase structure can contain various components. Typically, Japanese Unexamined Patent Application Publication (JP-A) No. 2006-342373 discloses a high-tensile galvanized steel sheet containing martensite, bainite, retained austenite, or a mixture of them and excelling typically in strength-ductility balance; JP-A No. 2007-009317 discloses a high-strength cold-rolled steel sheet containing austenitic low-temperature transformation phases of martensite, bainite, and pearlite and excelling in stretch flange formability; JP-A No. 2003-193188 discloses a high-tensile galvannealed steel sheet mainly containing bainite or pearlite as a second phase structure; and JP-A No. 2004-211126 discloses a galvanized steel sheet containing not regular martensite structure but tempered martensite as a second phase structure and excelling in formability such as stretch flange formability.

SUMMARY OF THE INVENTION

Under these circumstances, an object of the present invention is to provide a high-strength multi-phase steel sheet and a production method thereof, which high-strength multi-phase steel sheet contains a ferrite matrix and, as second phase structures, bainitic and martensitic low-temperature transformation phases and excels both in TS-EL balance and TS-λ balance at high strengths on the order of 590 to 780 MPa.

Specifically, according to an embodiment of the present invention, there is provided a steel sheet which contains 0.03 to 0.13 percent by mass of carbon (C), 0.02 to 0.8 percent by mass of silicon (Si), 1.0 to 2.5 percent by mass of manganese (Mn), 0.03 percent by mass or less of phosphorus (P), 0.01 percent by mass or less of sulfur (S), 0.01 to 0.1 percent by mass of aluminum (Al), 0.01 percent by mass or less of nitrogen (N), and at least one member selected from the group consisting of 0.004 to 0.1 percent by mass of titanium (Ti) and 0.004 to 0.07 percent by mass of niobium (Nb), with the remainder including iron and inevitable impurities. The steel sheet structurally has a ferrite matrix structure and bainitic and martensitic second phase structures, and the steel sheet has a ferrite fraction of from 50 to 86 percent by area, a bainite fraction of from 10 to 30 percent by area, and a martensite fraction of from 4 to 20 percent by area based on the entire structure, in which the bainite area fraction is larger than the martensite area fraction. In the steel sheet, the ferrite has an average grain size of 2.0 to 5.0 μm, and the ratio of the average hardness (Hv) of the ferrite to the tensile strength (MPa) of the steel sheet is equal to or more than 0.25.

The high-strength steel sheet according to the present invention may further contain at least one selected from the group consisting of the following (a), (b), and (c): (a) at least one member selected from the group consisting of 0.01 to 1 percent by mass of chromium (Cr) and 0.01 to 0.5 percent by mass of molybdenum (Mo); (b) 0.0001 to 0.003 percent by mass of boron (B); and (c) 0.0005 to 0.003 percent by mass of calcium (Ca).

Such high-strength steel sheets according to the present invention include cold-rolled steel sheets; galvanized steel sheets which have been subjected to galvanizing; and galvannealed steel sheets which have been subjected to galvannealing.

According to another embodiment of the present invention, there is provided a method for producing the steel sheet according to the present invention. This method includes the steps of preparing a cold-rolled steel sheet having the above-specified component composition and annealing the cold-rolled steel sheet, in which the annealing step sequentially includes heating the cold-rolled steel sheet to a temperature range (T1) equal to or higher than the $Ac_3$ point at an average heating rate of 5° C./s or more, holding the heated steel sheet in the temperature range (T1) for 10 to 300 seconds, cooling the steel sheet from the temperature range (T1) to a temperature range (T2) of from 400° C. to 600° C. at an average cooling rate of 2° C./s or more, holding the cooled steel sheet in the temperature range (T2) of from 400° C. to 600° C., and cooling the steel sheet, and in which the steel sheet is in the temperature range of from 400° C. to 600° C. for a residence time (t3) of from 40 to 400 seconds in the annealing step.

The high-strength steel sheets according to the present invention have properly controlled steel components and structures and thereby excel both in TS-EL balance and TS-λ balance. They are applicable even to portions where forming (molding) is difficult and are useful as automobile structural members.

DESCRIPTION OF THE PREFERRED EMBODIMENTS

Figure 1A:
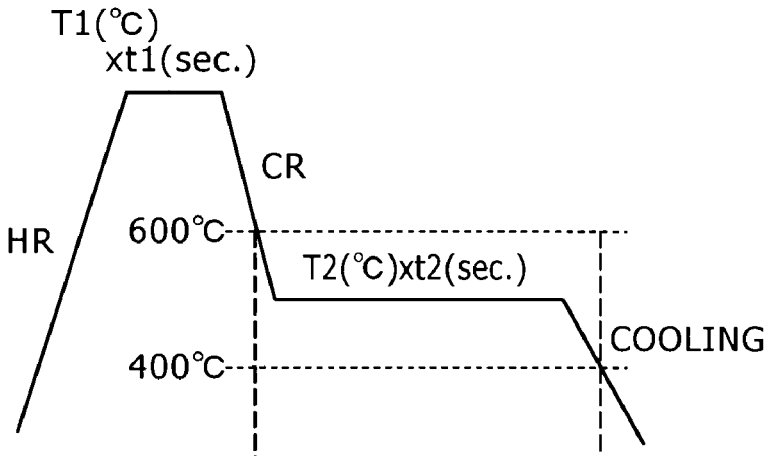
FIG. 1A is a schematic diagram showing a heat pattern for the production of a cold-rolled steel sheet according to the present invention.

The present invention relates to techniques for improving the formability of multi-phase steel sheets which contain a ferrite matrix and a second phase structure of a hard phase (low-temperature transformation phase) typically of martensite (M) and/or bainite (B) and have a tensile strength on the order of 590 to 780 MPa.

Specifically, high-strength steel sheets having satisfactory TS-EL balance and TS-λ balance equal to or superior to those of known multi-phase steel sheets can be obtained by controlling the composition and proportion of the second phase structure; controlling the hardness of the matrix structure; allowing the matrix structure to be finer (controlling the average grain size of ferrite); and positively adding Ti and Nb components to the steel. More specifically, the control of the hardness of the matrix structure is performed by controlling the average ferrite hardness to a specific level or more relative to the tensile strength of the steel sheet so as to reduce the difference in average hardness between the matrix ferrite and the bainitic and martensitic second phase structures, as compared with known multi-phase steel sheets.

As used herein a "high-strength steel sheet superior in formability" refers to a high-strength steel sheet that has a tensile strength on the order of 590 to 780 MPa and is superior in TS-EL balance and TS-λ balance. Specifically, the high-strength steel sheet satisfies the condition: [tensile strength (TS)]×[elongation (EL)]≧17000 and the condition: [tensile strength (TS)]×[hole expansion ratio (stretch flange formability) (λ)]≧160000 in the above-specified high strength range. More specifically, a steel sheet, if having a strength (tensile strength) on the order of 590 MPa (590 MPa or more and less than 780 MPa), preferably has an elongation (EL) of about 25% or more and a stretch flange formability (λ) of about 85% or more. A steel sheet, if having a strength on the order of 780 MPa (780 MPa or more and less than 980 MPa), preferably has an elongation (EL) of about 19% or more and a stretch flange formability (λ) of about 65% or more.

Such steel sheets according to embodiments of the present invention include not only cold-rolled steel sheets but also galvanized steel sheets (GI steel sheets) and galvannealed steel sheets (GA steel sheets). These plating treatments improve the corrosion resistance.

Steel Components

Initially, chemical components of the steels for use in the present invention will be described.

Carbon (C): 0.03 to 0.13 percent by mass

Carbon (C) element ensures high strength of the steel sheet and helps the formation of the low-temperature transformation phases (bainite and martensite). Carbon, if contained in a content of less than 0.03 percent by mass, may not effectively exhibit these activities. Carbon, if contained in a content of more than 0.13 percent by mass, may impair the ductility and/or weldability. The C content herein should therefore be from 0.03 to 0.13 percent by mass. The C content is preferably 0.05 percent by mass or more and 0.12 percent by mass or less.

Silicon (Si): 0.02 to 0.8 percent by mass

Silicon (Si) element is known as a solid-solution hardening element and effectively helps to improve the ductility. Silicon, if contained in a content of less than 0.02 percent by mass, may not effectively exhibit these activities. In contrast, silicon, if contained in a content of more than 0.8 percent by mass, may cause an oxide layer as a surface layer to cause failure to effect plating. Silicon, if contained in an excessively high content, may also accelerate ferrite transformation so as to retard bainite transformation, and this may impair the stretch flange formability. The Si content herein should therefore be 0.02 to 0.8 percent by mass. The Si content is preferably 0.03 percent by mass or more and 0.65 percent by mass or less.

Manganese (Mn): 1.0 to 2.5 percent by mass

Manganese (Mn) element stabilizes austenite to thereby help to form the low-temperature transformation phase and also contributes to the improvement of the ferrite hardness. However, manganese, if contained in an excessively high content, will reduce the ferrite fraction and increase the martensite fraction of the steel sheet to thereby impair the TS-EL balance. The Mn content herein should therefore be from 1.0 to 2.5 percent by mass. The Mn content is preferably 1.5 percent by mass or more and 2.3 percent by mass or less.

Phosphorus (P): 0.03 percent by mass or less

Phosphorus (P) element is an inevitable impurity in the steel sheet. Phosphorus, if contained in an excessively high content, may cause failure to effect plating and cause impaired weldability. The upper limit of the P content should therefore be 0.03 percent by mass. The P content is preferably controlled to be 0.02 percent by mass or less.

Sulfur (S): 0.01 percent by mass or less

Sulfur (S) is an inevitable impurity in the steel sheet. Sulfur causes hot crack during hot rolling and easily forms inclusions such as MnS in the steel sheet to thereby cause impaired stretch flange formability. The upper limit of the S content should therefore be 0.01 percent by mass. The less the S content is, the better. The S content is preferably controlled to be 0.005 percent by mass or less.

Aluminum (Al): 0.01 to 0.1 percent by mass

Aluminum (Al) acts as a deoxidizing agent. The lower limit of the Al content herein should be 0.01 percent by mass for effectively exhibiting the activity. In contrast, aluminum, if contained in an excessively high content, may adversely affect the cleanliness of the steel, and the upper limit of the Al content should therefore be 0.1 percent by mass. The Al content is preferably 0.02 percent by mass or more and 0.07 percent by mass or less.

Nitrogen (N) 0.01 percent by mass or less

Nitrogen, if contained in an excessively high content, may impair the ductility due to strain aging, and the upper limit of the N content should therefore be 0.01 percent by mass. The N content is preferably controlled to be 0.005 percent by mass or less.

Titanium (Ti): 0.004 to 0.1 percent by mass and/or niobium (Nb) 0.004 to 0.07 percent by mass Titanium (Ti) and niobium (Nb) elements are most specific components in the steel for use in the present invention. Steel sheets, if not having suitably controlled contents of these elements, will not have desired mechanical properties regarding TS×EL and TS×λ, as described in the after-mentioned experimental Examples, and their ferrite grain size may be increased.

Specifically, titanium and niobium are combined with carbon and/or nitrogen to form carbides and/or nitrides, and these precipitates exhibit pinning effects during annealing to inhibit ferrite grain growth to thereby help the ferrite structure to be finer, thus improving the mechanical properties. However, if titanium and niobium are contained in an excessively high content, the activities will be saturated but contrarily cause coarse carbides and nitrides to thereby impair the stretch flange formability. The Ti content and Nb content herein should therefore be from 0.004 to 0.1 percent by mass and from 0.004 to 0.07 percent by mass, respectively. The Ti content is preferably 0.01 percent by mass or more and 0.08 percent by mass or less. The Nb content is preferably 0.009 percent by mass or more and 0.05 percent by mass or less. The steels for use in the present invention may contain either one or both of Ti and Nb, whereas the above-specified respective contents should be satisfied.

The steel sheets according to the present invention have the above component composition, with the remainder including iron and inevitable impurities. The steel sheets may further contain other elements (acceptable components) within ranges not adversely affecting the characteristic properties, and the resulting steel sheets are also included within the scope of the present invention.

Typically, it is also effective to allow the steel sheets to further contain, as selective elements according to necessity, at least one selected typically from (a) 0.01 to 1 percent by mass of chromium (Cr) and/or 0.01 to 0.5 percent by mass of molybdenum (Mo); (b) 0.0001 to 0.003 percent by mass of boron (B); and (c) 0.0005 to 0.003 percent by mass of calcium (Ca) in order to further improve the TS-EL balance and TS-λ balance. These selective components will be illustrated below.

Chromium (Cr): 0.01 to 1 percent by mass and/or molybdenum (Mo) 0.01 to 0.5 percent by mass Chromium (Cr) and molybdenum (Mo) elements each stabilize austenite, accelerate the formation of the low-temperature transformation phase, and mainly contribute to the improvement of the strength. However, chromium, if contained in an excessively high content, will not only impair the TS-λ balance but also adversely affect the surface quality. Molybdenum, if contained in an excessively high content, will not only increase the cost but also impair the ductility. The Cr content and the Mo content are preferably from 0.01 to 1 percent by mass and from 0.01 to 0.5 percent by mass, respectively. The Cr content is more preferably 0.1 percent by mass or more and is more preferably 0.5 percent by mass or less. The Mo content is more preferably 0.1 percent by mass or more and 0.3 percent by mass or less.

Boron (B): 0.0001 to 0.003 percent by mass

Boron (B) element increases the hardenability and helps the formation of a low-temperature transformation phase that is effective to allow the steel sheet to have higher strength. The B content is therefore preferably 0.0001 percent by mass or more. In contrast, boron, if contained in an excessively high content, will impair the ductility. The B content is preferably 0.003 percent by mass or less. The B content is more preferably 0.001 percent by mass or more and 0.002 percent by mass or less.

Calcium (Ca): 0.0005 to 0.003 percent by mass

Calcium (Ca) element effectively controls the shape of sulfide inclusions such as MnS, but calcium, if contained in an excessively high content, will increase the cost. The Ca content herein is therefore preferably from 0.0005 to 0.003 percent by mass. The Ca content is more preferably 0.001 percent by mass or more and 0.002 percent by mass or less.

The high-strength steel sheets according to the present invention are useful as thin steel sheets such as steel sheets for automobiles and their thicknesses are preferably from about 0.8 to about 2.3 mm.

Structure

Next, the structure featuring the steel sheets according to the present invention will be described.

As is described above, the steel sheets according to the present invention are multi-phase steel sheets that contain a ferrite as a matrix and martensitic and bainitic low-temperature transformation phases as second phases. As used herein a "matrix" refers to a phase (main phase) that occupies a half or more of the entire structure and refers to ferrite herein. As used herein a "second phase structure" refers to other phases than the matrix and refers to bainite and martensite herein. In this connection, the total of structures constituting the second phase structure occupies not more than half of the entire structure. The steel sheets according to the present invention have a bainite fraction larger than a martensite fraction, contain martensite in a relatively high content of 4 percent by area or more, and are categorized as tri-phase steel sheets containing ferrite, bainite, and martensite phases.

Specifically, the steel sheets each have, relative to the entire structure, a ferrite fraction of from 50 to 86 percent by area, a bainite fraction of from 10 to 30 percent by area, and a martensite fraction of from 4 to 20 percent by area, in which the bainite fraction is larger than the martensite fraction, the average ferrite grain size is from 2.0 to 5.0 μm, and the ratio of the average ferrite hardness (Hv) to the tensile strength (MPa) of the steel sheet is equal to or more than 0.25.

Matrix Structure: Ferrite Fraction; 50 to 86 Percent by Area

As used herein "ferrite" refers to polygonal ferrite, i.e., ferrite having a low dislocation density. The ferrite is an important structure to contribute to the improvement of elongation properties and should occupy 50 percent by area or more of the entire structure so as to ensure satisfactory elongation properties. In contrast, ferrite, if contained in a fraction of more than 86 percent by area, will impair the strength. The ferrite fraction should therefore be from 50 to 86 percent by area. The ferrite fraction is preferably from 60 to 80 percent by area.

Bainite Fraction: 10 to 30 Percent by Area

Bainite deforms with the deformation of ferrite to thereby suppress void generation and is very useful to improve the stretch flange formability. The bainite fraction should therefore be 10 percent by area or more. However, bainite, if contained in an excessively high fraction, will impair the ductility, and the upper limit of the bainite fraction should be 30 percent by area. A preferred lower limit of the bainite fraction is 15 percent by area and a preferred upper limit thereof is 26 percent by area.

Martensite Fraction: 4 to 20 Percent by Area

Martensite fraction should be controlled within a specific range so as to ensure predetermined strength and stretch flange formability. Specifically, the martensite structure helps to improve the strength to thereby contribute to the improvement of the TS-EL balance. The lower limit of the martensite fraction should therefore be 4 percent by area. In contrast, martensite, if contained in an excessively large fraction, will impair the elongation and stretch flange formability. This is probably because martensite little deforms due to its hardness during working, thus causes voids in the vicinity of martensite, and the voids accelerate cracking and impair the stretch flange formability. The upper limit of the martensite fraction herein should therefore be 20 percent by area. The martensite fraction is preferably 5 percent by area or more and 18 percent by area or less.

The martensite in the present invention differs from the tempered martensite described in JP-A No. 2004-211126 and is a martensite formed by cooling the steel sheet after holding at a holding temperature T2 or after galvanizing or alloying (galvannealing). The resulting martensite differs from the tempered martensite described in JP-A No. 2004-211126 in that the former has a high dislocation density and is a hard structure. These structures are clearly distinguishable from each other typically by transmission electron microscopic (TEM) observation.

Bainite Fraction Larger than Martensite Fraction

As is described above, it is important in the present invention not only to respectively control the fractions of martensite and bainite but also to suitably control the ratio of the bainite fraction to the martensite fraction. This retards the generation of elongation flange cracks. The difference (B−M) between the bainite fraction (B) and the martensite fraction (M) is used herein as an index for ensuring higher stretch flange formability so as to obtain superior TS-λ balance. For exhibiting desired properties, the bainite fraction B should be larger than martensite fraction M (B>M), namely, B minus M should be larger than zero (B-M>0). The larger the difference (B−M) is, the more superior properties are obtained. The difference (B−M) is preferably 2 percent by area or more.

The steel sheets according to the present invention may contain ferrite, bainite, and martensite alone but may further contain any other structure(s) within ranges not adversely affecting the advantages of the present invention. As used herein the "other structure(s)" refers typically to structures that form inevitably in the production process and include structures of pseudo pearlite and retained austenite. The total content of such "other structures" is preferably about 3 percent by area or less.

Average Ferrite Grain Size: 2.0 to 5.0 μm

The average ferrite grain size affects improvements of the TS-EL balance and TS-λ balance, as described in after-mentioned experimental Examples. Specifically, ferrite, if having an average grain size of less than 2.0 μm, may adversely affect the TS-EL balance, may cause an excessively high yield ratio, and this may increase the springback upon press forming to typically cause inferior dimensional accuracy. In contrast, ferrite, if having an average grain size of more than 5.0 μm, may adversely affect the TS-EL balance and TS-λ balance. The average ferrite grain size should therefore be from 2.0 to 5.0 μm. The upper limit of the average ferrite grain size is preferably 4.0 μm.

(Average Hardness of Ferrite (Hv))/(Tensile Strength of the Steel Sheet (MPa))≧0.25

The ratio of the average ferrite hardness to the tensile strength of the steel sheet is an important factor that contributes to the improvement of TS-λ balance. The difference in hardness between ferrite and the second phase in multi-phase steel sheets can be reduced by allowing the ferrite to have hardness at a specific level or more with respect to the strength of the steel sheet. The average ferrite hardness is preferably 160 Hv (hardness value of Vickers) or more in steel sheets having a tensile strength on the order of 590 MPa and is preferably 200 Hv or more in steel sheets having a tensile strength on the order of 780 MPa. Ferrite, if having a higher hardness as above, also effectively helps to improve the tensile strength of steel sheet.

Though the higher the ferrite hardness is, the better from the viewpoint of improvement of the TS-λ balance, the ratio of the average ferrite hardness (Hv) to the tensile strength of the steel sheet (MPa) is preferably 0.30 or less, and more preferably 0.28 or less in consideration of other properties such as TS-EL balance.

As is described above, the ferrite herein is controlled to be fine and to have a high hardness, and this will also suppress the generation of voids due to the difference in hardness between ferrite and martensite. Additionally, the martensite fraction is controlled to be less than the bainite fraction, and voids, even if generated, little affect the TS-λ balance, but the martensite rather further helps to improve the steel sheet strength to thereby improve the TS-EL balance.

Production Method

Next, a method for producing the steel sheets according to the present invention will be illustrated.

For producing the steel sheets according to the present invention satisfying the above-specified conditions, it is effective to suitably control an annealing process performed subsequent to cold rolling. Specifically, an annealing process (including plating and/or alloying) is carried out subsequent to the cold rolling to produce a predetermined high-strength steel sheet. The annealing process sequentially includes processes of "soaking, cooling, holding in a temperature range of from 400° C. to 600° C., and cooling". In the annealing process, it is important to control an average rate (HR) of heating to the soaking temperature (T1), soaking conditions [soaking temperature (T1) and soaking time (t1)], and a cooling rate (CR) to a temperature (T2) of holding performed subsequent to the soaking; and to control a residence time (t3) in a temperature range of from 400° C. to 600° C. to be within a predetermined range. This suitably controls the proportions of the matrix structure and the second phase structure and ensures the generation of highly hard ferrite and/or fine ferrite, resulting in steel sheets superior in desired mechanical properties (see after-mentioned experimental Examples).

Figure 1B:
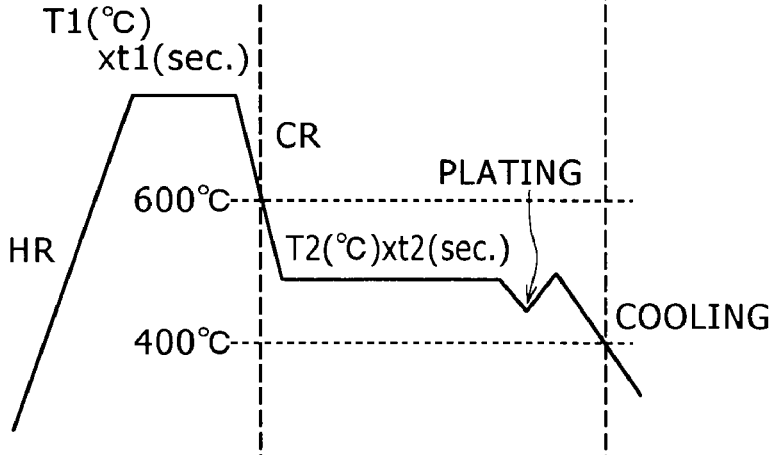
FIGS. 1B and 1C are schematic diagrams showing heat patterns for the production of a galvanized steel sheet and a galvannealed steel sheet, respectively, according to the present invention.
Figure 1C:
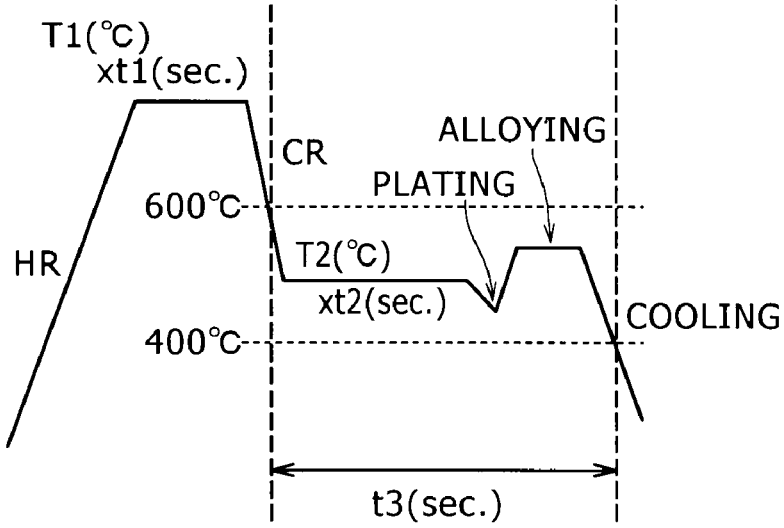

The annealing process which features the production method according to the present invention will be illustrated in detail with reference to FIGS. 1A, 1B, and 1C. These figures illustrate heat patterns according to the types of steel sheets. Specifically, FIG. 1A illustrates a heat pattern for the production of a cold-rolled steel sheet; FIG. 1B illustrates a heat pattern for the production of a galvanized steel sheet (GI); and FIG. 1C illustrates a heat pattern for the production of a galvannealed steel sheet (GA). It should be noted that the conditions (HR, T1, t1, T2, CR, and t3) to be controlled in the annealing process are in common in the respective types of steel sheets, whereas a plating process (and an alloying process) is added in the heat patterns for the production of a galvanized steel sheet and a galvannealed steel sheet to that for the production of a cold-rolled steel sheet.

The annealing process which features the production method according to the present invention will be sequentially illustrated step by step.

(1) Heating to Temperature Range (T1) Equal to or Higher than the $Ac_3$ Point at Average Heating Rate (HR) of 5° C./s or More Initially, a cold-rolled steel sheet having a component composition satisfying the above conditions is heated to a soaking temperature range ("T1" in FIGS. 1A, 1B, and 1C) to a temperature equal to or higher than the $Ac_3$ point at an average heating rate ("HR" in FIGS. 1A, 1B, and 1C) of 5° C./s or more. As is demonstrated in experimental Examples below, the average heating rate HR significantly affects the control of the average ferrite hardness. The heating, if conducted at an average heating rate HR of less than 5° C./s, may not sufficiently act to improve the ferrite hardness due to precipitation hardening by precipitates such as NbC and TiC. This is probably because precipitates such as NbC and TiC become coarse during such heating, Nb and Ti are re-dissolved during annealing in the austenite region and are decreased in their amounts, and whereby the precipitates are precipitated in less amounts in the ferrite structure during the cooling process. Additionally, the heating, if conducted at an average heating rate HR of less than 5° C./s, may enhance the dispersion of manganese (Mn) from the ferrite into the austenite during dual-phase annealing, and this makes the ferrite become softer so as to fail to ensure sufficient ferrite hardness. The average heating rate HR herein should therefore be 5° C./s or more. The average heating rate HR is preferably 10° C./s or more, and more preferably 12° C./s or more. Though not especially limited in its upper limit, the average heating rate HR is operationally preferably about 20° C./s or less.

The heating temperature (soaking temperature) T1 is a factor that affects the ferrite grain size and the ferrite hardness. If the heating (soaking) is conducted to a heating temperature T1 of lower than the $Ac_3$ point, manganese (Mn) and precipitates such as NbC may not be sufficiently re-dissolved, and the resulting precipitation hardening may not effectively act to increase the ferrite hardness, and this may impair the TS-λ balance. Additionally, if the heating (soaking) is conducted to a soaking temperature T1 of lower than the $Ac_3$ point, a worked structure remains in the steel sheet so as to reduce the ferrite grain size, and this may cause an excessively high yield strength and inferior TS-EL balance. The soaking temperature T1 herein should therefore be a temperature equal to or higher than the $Ac_3$ point. A preferred lower limit of the soaking temperature T1 is a temperature about 30° C. higher than the $Ac_3$ point. Though not especially limited in its upper limit, the soaking temperature T1 is operationally preferably about 950° C. or lower.

The $Ac_3$ point herein is calculated according to the following equation:

$$Ac_3 \text{ point } (^\circ \text{C.}) = 910 - 203[C]^{0.5} + 44.7[Si] + 31.5[Mo] - 30[Mn] - 11[Cr] + 700[P] + 400[Al] + 400[Ti]$$

wherein the symbol "[(element name)]" represents the content of the element (percent by mass).

(2) Soaking in Temperature Range (T1) Equal to or Higher than the $Ac_3$ Point for Holding Time (t1) of from 10 to 300 Seconds When the temperature is raised as above and reaches a temperature range equal to or higher than the $Ac_3$ point, the steel sheet is soaked by holding within the temperature range for a predetermined time ("t1" in FIGS. 1A, 1B, and 1C). As used herein "the temperature range" refers to a temperature range equal to or higher than the $Ac_3$ point, and it is not always necessary to hold the steel sheet at the same temperature (isothermal holding), as long as the above condition is satisfied. The soaking holding time t1 herein is a factor that affects, for example, the ferrite hardness. If soaking is conducted for a holding time t1 of less than 10 seconds, manganese (Mn) and precipitates such as NbC may not be sufficiently redissolved, and this may impair the TS-λ balance. The soaking holding time t1 herein should therefore be 10 seconds or more, and is preferably 30 seconds or more and more preferably 40 seconds or more. The upper limit of the soaking holding time t1 is determined in consideration mainly typically of productivity and production efficiency. Soaking, if conducted for a holding time t1 of more than 300 seconds, may require an excessively long production line or cause an excessively low production speed to thereby cause extra load for design change. The upper limit of the soaking holding time t1 herein should therefore be 300 seconds. A preferred upper limit of the soaking holding time is 200 seconds.

(3) Cooling in Temperature Range (T1→T2) of from Soaking Temperature Range (T1) to Temperature of from 400° C. to 600° C. (T2) at Average Cooling Rate (CR) of 2° C./s or More Subsequent to the soaking under the conditions, the steel sheet is cooled in a temperature range (T1→T2) of from the soaking temperature range T1 to a temperature range ("T2" in FIGS. 1A, 1B, and 1C) of from 400° C. to 600° C. at an average cooling rate ("CR" in FIGS. 1A, 1B, and 1C) of 2° C./s or more. The average cooling rate CR is a factor that is controlled to suppress the generation of ferrite and pearlite and to accelerate the generation of the bainitic and martensitic second phase structures. Cooling, if conducted at an average cooling rate CR of less than 2° C./s, may cause an excessively high ferrite fraction and cause the generation of pearlite, whereby desired second phase structures may not be obtained. Additionally, cooling, if conducted at an excessively low average cooling rate CR, may cause decreased productivity and invite problems in facilities. The average cooling rate CR herein should therefore be 2° C./s or more. A preferred lower limit of the average cooling rate is 5° C./s. Though not especially limited in its upper limit, the average cooling rate CR is operationally preferably about 25° C./s or less.

(4) Holding in Temperature Range (T2) of from 400° C. to 600° C., and Subsequently Cooling Subsequent to the cooling to a temperature range T2 as above, the steel sheet is held at a temperature within the range T2 of from 400° C. to 600° C. for a predetermined time ("t2" in FIGS. 1A, 1B, and 1C) and is then cooled to room temperature. As long as the holding is conducted in a holding temperature T2, it is not always necessary to hold the steel sheet at the same temperature (isothermal holding). The holding time t2 in the temperature range T2 will be described in detail in the step (5) below. Cooling from the temperature range T2 to room temperature (T2→room temperature) is preferably conducted at an average cooling rate of about 3° C./s or more, and this ensures a desired martensite fraction. The cooling can be conducted according to a common procedure such as gas jet cooling.

(5) Controlling Residence Time (T3) in Temperature Range of from 400° C. to 600° C. to be from 40 to 400 Seconds It is very important in the present invention to suitably control the residence time ("t3" in FIGS. 1A, 1B, and 1C) within a temperature range of from 400° C. to 600° C., in which the residence time t3 includes the holding time t2 in the temperature range T2. This allow bainitic (B) and martensitic (M) low-temperature transformation phases to be contained in the steel sheet in specific proportions specified in the present invention, in which the bainite fraction B is from 10 to 30 percent by area, the martensite fraction M is from 4 to 20 percent by area; and the bainite fraction B and the martensite fraction M satisfy the condition: $B>M \geqq 4$ percent by area. This is because bainite phase is a low-temperature transformation phase that transforms in the temperature range of from 400° C. to 600° C., and the space factors of bainite and martensite vary depending on the time (duration) of passing through (residing in) the temperature range.

As used herein the "residence time t3 in the temperature range of from 400° C. to 600° C." briefly refers to a total time during which the steel sheet passes through (resides in) the temperature range of from 400° C. to 600° C. and includes not only the holding time t2 in the temperature range T2 but also any other times (durations) during which the steel sheet resides in the temperature range (400° C. to 600° C.) in any cooling and heating processes.

How the residence time "t3" is calculated corresponding to the types of the steel sheets will be explained below.

Typically, in the case of cold-rolled steel sheets, the residence time "t3" is represented by the total of the residence time in a temperature range from 600° C. to T2, the holding time t2 in the temperature range T2, and the residence time in a temperature range from T2 to 400° C. (FIG. 1A). The annealing condition No. 6 in Table 2 in after-mentioned experimental Examples is a production example of a cold-rolled steel sheet, in which the residence time "t3" is calculated as a total time (395 seconds) of (a), (b), and (c) as below.

(a) Residence time at temperatures from 600° C. to T2 (=480° C.): 10.9 seconds (cooling in the temperature range at an average cooling rate CR of 11° C./s)

(b) Holding time t2 at T2 (=480° C.): 380 seconds (c) Residence time at temperatures from T2 (=480° C.) to 400° C.: 4 seconds (cooling in the temperature range at an average cooling rate of 20° C./s)

In the case of galvanized steel sheets (GI), most of them are immersed in a plating bath immediately after the isothermal holding in the temperature range T2. In this case, the residence time "t3" is calculated in the same manner as in the cold-rolled steel sheets. Where necessary, some galvanized steel sheets are immersed in a plating bath after being cooled to a predetermined temperature subsequent to the isothermal holding in the temperature range T2. In this case, the residence time in the temperature range (400° C. to 600° C.) is added, whereas this residence time may vary depending on the conditions of the cooling. The annealing condition No. 7 in Table 2 in experimental Examples is a production example of a galvanized steel sheet (GI), in which the residence time "t3" is calculated as a total time (76 seconds) of (a), (b), and (c) as below.

(a) Residence time at temperatures from 600° C. to T2 (=430° C.): 24.2 seconds (cooling in the temperature range at an average cooling rate CR of 7° C./s)

(b) Holding time t2 at T2 (=430° C.): 50 seconds (c) Residence time at temperatures from T2 (=430° C.) to 400° C.: 1.5 seconds (cooling in the temperature range at an average cooling rate of 20° C./s)

In the case of galvannealed steel sheets (GA), most of them are immersed in a plating bath immediately after the isothermal holding in the temperature range T2 and heated for alloying (for example, at a temperature of about 500 to 600° C. for a duration of about 2 to 60 seconds). In this case, the residence time "t3" is calculated by adding an additional residence time, corresponding to the alloying time, to the calculated residence time in the cold-rolled steel sheet. Typically, the annealing condition No. 1 in Table 2 in experimental Examples below is a production example of a galvannealed steel sheet (GA), in which the residence time "t3" is calculated as a total time (115 seconds) of (a), (b), (c), and (d) as below.

(a) Residence time at temperatures from 600° C. to T2 (=440° C.): 12.3 seconds (cooling in the temperature range at an average cooling rate CR of 13° C./s)

(b) Holding time t2 at T2 (=440° C.): 75 seconds (c) Alloying time: 20 seconds (d) Residence time at temperatures from alloying temperature (=550° C.) to 400° C.: 7.5 seconds (cooling in the temperature range at an average cooling rate CR of 20° C./s)

The residence time "t3" thus calculated is very important for ensuring a desired structure (particularly a structure having a bainite fraction larger than a martensite fraction) and the suitable control of the residence time t3 in the temperature range of from 400° C. to 600° C. gives a steel sheet having a desired area fraction. This temperature range (about 400° C. to about 600° C.) substantially coincides with the temperature ranges of galvanizing and galvannealing processes, and the fractions typically of bainite and martensite are affected by plating (galvanizing) and alloying. In the production of galvanized steel sheets and galvannealed steel sheets, the total residence time t3 further including the times (durations) for plating and alloying is controlled in the present invention. As demonstrated in experimental Examples, the control of the residence time t3 in the temperature range of from 40 to 400 seconds accelerates bainite transformation to give bainite and martensite in predetermined fractions, regardless of the presence or absence of plating and alloying processes. In contrast, if the steel sheet resides in the temperature range for a residence time t3 of less than 40 seconds, the bainite transformation may not sufficiently proceed, a predetermined bainite fraction may not be obtained, and this may impair the TS-λ balance. If the steel sheet resides in the temperature range for a residence time t3 of more than 400 seconds, the bainite fraction may become excessively large so as to relatively reduce the martensite fraction, and this may impair the TS-EL balance. The residence time t3 is preferably from 50 to 380 seconds.

The holding time t2 in the temperature range T2 is preferably from about 20 to about 350 seconds and more preferably from about 30 to about 300 seconds, regardless of the presence or absence of plating and alloying processes.

It should be noted that the production method according to the present invention is not intended to limit the conditions in plating and alloying, except for the residence time t3, and any common or regular conditions may be suitably employed. Among the conditions of the plating bath, for example, the temperature of the plating bath is preferably in a range from about 400° C. to about 600° C. and more preferably from about 400° C. to about 500° C. The alloying process, if further conducted, may be conducted at a temperature of from about 500° C. to about 600° C. for a duration of from about 2 to about 60 seconds. The heating procedure in the alloying process is not especially limited and can be selected from among various common procedures such as gas heating and induction heating.

The annealing process which features the production method according to the present invention has been described above.

In the production method according to the present invention, it is important to suitably control the annealing process performed subsequent to cold rolling, and other processes such as hot rolling, coiling, cold rolling, and galvanizing/galvannealing (other plating and alloying conditions than the residence time) may be carried out according to common procedures under common conditions. Specifically, common procedures or processes can be employed to give desired multi-phase steel sheets.

Next, preferred embodiments of the present invention will be illustrated below, which, however, are by no means intended to limit the scope of the present invention.

Initially, a steel slab having a component composition satisfying the conditions is sequentially subjected to heating to a temperature of about 1200° C. or higher; hot rolling at a temperature approximately equal to or higher than the $Ar_3$ point; cooling to a temperature ranging from about 400° C. to about 650° C.; coiling; acid pickling according to necessity; cold rolling; and the annealing process.

The heating temperature in the hot rolling is preferably about 1200° C. or higher, and more preferably 1250° C. or higher, and this allows steel components to be more readily uniformly dissolved in the austenite structure. The finish temperature of the hot rolling is preferably approximately equal to or higher than the $Ar_3$ point and more preferably a temperature 30° C. to 50° C. higher than the $Ar_3$ point. The coiling temperature is preferably at highest about 650° C. or lower. Coiling, if conducted at an excessively high temperature higher than the above-specified temperature, may impair the surface quality due typically to generation of scale defects. However, coiling, if conducted at an excessively low temperature, may cause the steel sheet to have an excessively high strength, and this will impede the cold rolling. The lower limit of the coiling temperature is therefore preferably about 400° C.

After conducting hot rolling as above and acid pickling according to necessity, cold rolling is performed. The cold rolling is preferably performed at a draw ratio in a range of from 20% to 60%. For allowing the structure to be finer in the subsequent annealing process, it is effective to impart sufficient strain to the hot-rolled steel sheet. The cold rolling draw ratio is therefore preferably 20% or more and more preferably 30% or more. In contrast, in consideration typically of load on the facilities, the cold rolling draw ratio is preferably about 65% or less and more preferably about 60% or less.

The present invention will be illustrated in further detail with reference to several working examples below. It should be noted, however, that these examples are never intended to limit the scope of the present invention; various alternations and modifications may be made without departing from the scope and spirit of the present invention and are all included within the technical scope of the present invention.

Experimental Examples

A series of steels having compositions given in Table 1 was molten and cast to give steel ingots. The steel ingots were heated to 1250° C., hot-rolled at a finish temperature of from 880° C. to 900° C., cooled, and cooled in the furnace at 550° C. for 30 minutes to yield hot-rolled steel sheets (thickness: 2.8 mm). Next, the hot-rolled steel sheets were subjected to acid pickling and cold rolling to yield cold-rolled steel sheets 1.6 mm thick. The cold-rolled steel sheets were then subjected to annealing under conditions given in Table 2. The average cooling rate from the holding temperature to room temperature was 20° C./s.

For galvanized steel sheets (indicated as "GI" in Table 2), the steel sheets after holding at a holding temperature T2 given in Table 2 were immersed in a plating bath whose temperature was controlled at 450° C. For galvannealed steel sheets (indicated as "GA" in Table 2), the steel sheets were subjected to alloying treatment at 550° C. for 20 seconds subsequent to the galvanizing. The average cooling rate to room temperature after the galvanizing or after the alloying was 20° C./s.

TABLE 1

| | Chemical composition (percent by mass) *the remainder being iron and inevitable impurities | | | | | | | | | | | | | |
|---|---|---|---|---|---|---|---|---|---|---|---|---|---|---|
| Steel type | C | Si | Mn | P | S | Al | Ti | Nb | Mo | Cr | B | Ca | N | $Ac_3$ (° C.) |
| A | 0.070 | 0.03 | 2.11 | 0.009 | 0.004 | 0.036 | | 0.050 | | | | | 0.0042 | 815 |
| B | 0.120 | 0.03 | 2.10 | 0.011 | 0.003 | 0.040 | | 0.006 | | | | | 0.0043 | 802 |
| C | 0.055 | 0.65 | 1.65 | 0.012 | 0.004 | 0.035 | 0.080 | | | | | | 0.0036 | 896 |
| D | 0.065 | 0.03 | 2.05 | 0.009 | 0.002 | 0.036 | 0.009 | | | 0.3 | | | 0.0035 | 819 |
| E | 0.060 | 0.20 | 2.10 | 0.009 | 0.002 | 0.035 | | 0.050 | 0.2 | | | | 0.0038 | 833 |
| F | 0.060 | 0.03 | 2.30 | 0.009 | 0.002 | 0.036 | 0.040 | 0.020 | | | 0.002 | | 0.0039 | 829 |
| G | 0.063 | 0.03 | 1.95 | 0.008 | 0.002 | 0.041 | 0.020 | | | 0.1 | | 0.0015 | 0.0037 | 831 |
| H | 0.065 | 0.90 | 1.90 | 0.008 | 0.004 | 0.035 | | 0.009 | | | | | 0.0031 | 861 |
| J | 0.070 | 0.03 | 2.11 | 0.009 | 0.004 | 0.036 | | 0.100 | | | | | 0.0043 | 815 |
| K | 0.065 | 0.03 | 2.05 | 0.009 | 0.002 | 0.036 | 0.003 | | | | | | 0.0044 | 820 |
| L | 0.120 | 0.03 | 2.10 | 0.011 | 0.003 | 0.040 | 0.150 | 0.005 | | | | | 0.0033 | 862 |
| M | 0.070 | 0.03 | 2.40 | 0.009 | 0.002 | 0.036 | | 0.001 | | | | | 0.0045 | 806 |
| N | 0.140 | 0.50 | 2.40 | 0.009 | 0.002 | 0.036 | | 0.009 | | | | | 0.0044 | 805 |
| P | 0.070 | 0.20 | 2.70 | 0.009 | 0.002 | 0.036 | 0.008 | | | | | | 0.0043 | 808 |
| Q | 0.020 | 0.40 | 1.60 | 0.009 | 0.002 | 0.037 | | 0.008 | | | | | 0.0044 | 872 |

TABLE 2

| Annealing condition No. | Average heating rate HR (° C./sec.) | Soaking temperature T1 (° C.) | Soaking time t1 (sec.) | Average cooling rate from T1 to T2 CR (° C./sec.) | Holding temperature T2 (° C.) | Holding time at T2 t2 (sec.) | Plating*1 | Residence time at temperatures from 400° C. to 600° C. t3 (sec.) |
|---|---|---|---|---|---|---|---|---|
| 1 | 16 | 890 | 70 | 13 | 440 | 75 | GA | 115 |
| 2 | 10 | 870 | 60 | 7 | 430 | 70 | GA | 122 |
| 3 | 12 | 860 | 55 | 8 | 420 | 60 | GI | 84 |
| 4 | 18 | 880 | 45 | 14 | 450 | 50 | GA | 88 |
| 5 | 14 | 870 | 75 | 11 | 460 | 75 | GA | 115 |
| 6 | 11 | 880 | 140 | 11 | 480 | 380 | none | 395 |
| 7 | 2.0 | 870 | 60 | 7 | 430 | 50 | GI | 76 |
| 8 | 15 | 780 | 45 | 13 | 450 | 65 | GA | 104 |
| 9 | 11 | 860 | 5 | 6 | 420 | 60 | GA | 118 |
| 10 | 11 | 890 | 70 | 10 | 620 | 75 | none | 10 |
| 11 | 16 | 880 | 45 | 16 | 380 | 70 | none | 13 |
| 12 | 10 | 870 | 75 | 11 | 440 | 10 | GI | 27 |
| 13 | 11 | 880 | 140 | 11 | 420 | 450 | none | 467 |

*1"none": no plating, "GI": galvanizing, "GA": galvannealing

The resulting steel sheets were subjected to measurements of fractions of respective structures, average ferrite grain size, average ferrite hardness, and mechanical properties according to the following procedures.

Fractions of Structures

Test pieces 20 mm wide, 20 mm long, and 1.6 mm thick were cut from the respective steel sheets, their cross sections in parallel with the rolling direction were ground, subjected to LePera etching, and measurements were conducted in portions of depth one-fourth the thickness.

Fractions of respective structures were determined by observing a measurement region of about 80 μm long and about 60 μm wide with an optical microscope at a magnification of 1000 times and analyzing images. Measurements were conducted in arbitrary five view fields, and the measured ratios (area fractions) of each structure in the five view fields were averaged to give a fraction of the structure.

Ferrite Grain Size

Diameters of the equivalent circles of respective ferrite grains were determine with an image analyzer in the same measurement region as the structure fractions, and the average of the determined diameters was defied as a ferrite grain size.

Ferrite Hardness

Test pieces 20 mm wide, 20 mm long, and 1.6 mm thick were cut from the respective steel sheets, and the hardness of ferrite at a position around one-fourth the thickness in a cross section in parallel with the rolling direction was measured under a load of 1 g according to the method specified in Japanese Industrial Standards (JIS) JIS Z 2242 (Vickers Hardness Test-Test Method). Measurements were conducted at twenty points, and the measurements at eighteen points excluding the maximum and minimum measurements were averaged.

Tensile Strength, Elongation, and Yield Strength

JIS No. 5 test pieces were sampled from the steel sheets in a direction perpendicular to the rolling direction and subjected to measurements of tensile strength (TS) and total elongation (EL) according to the methods specified in JIS Z 2241. Additionally, they were also subjected to the measurements of yield strength (YS). In this experimental Examples, a sample satisfying the condition: (tensile strength (TS))×(elongation (EL))≧17000 is indicated by "A" (accepted); and one not satisfying the condition is indicated by "F" (failed).

Stretch Flange Formability

In accordance with Japan Steel Federation Standards JFST 1001, test pieces were sampled, a hole having an initial diameter $d_i$ of 10 mm was formed by punching and was subjected to a hole expanding work on burr with a 60° conical punch, then a hole diameter $d_b$ upon crack penetration was measured, and a hole expansion limit λ (%) (also referred to as "hole expansion ratio λ") was calculated according to the equation below. In this experimental Example, a sample satisfying the condition: (tensile strength (TS))×(hole expansion limit λ (%))≧60000 is indicated by "A" (accepted); and one not satisfying the condition is indicated by "F" (failed).

$$\text{Hole expansion limit } \lambda\ (\%)=\{(d_b-d_i)/d_i\}\times 100$$

The results of these measurements are shown in Table 3, in which "GI" represents a galvanized steel sheet; and "GA" represents a galvannealed steel sheet.

TABLE 3

| Steel sheet No. | Steel type | Production process: Annealing condition No. | Plating*1 | Hardness (Hv) | Grain size (μm) | Structure*2: F (%) | B (%) | M (%) | B > M |
|---|---|---|---|---|---|---|---|---|---|
| 1 | A | 1 | GA | 170 | 2.4 | 68 | 26 | 6 | A |
| 2 | A | 3 | GI | 167 | 2.5 | 68 | 23 | 9 | A |
| 3 | A | 5 | GA | 168 | 2.5 | 67 | 25 | 8 | A |
| 4 | B | 3 | GI | 168 | 3.3 | 74 | 19 | 7 | A |
| 5 | C | 4 | GA | 162 | 2.4 | 66 | 23 | 11 | A |
| 6 | C | 6 | none | 162 | 2.3 | 68 | 25 | 7 | A |
| 7 | D | 4 | GA | 170 | 2.9 | 66 | 23 | 11 | A |
| 8 | E | 1 | GA | 221 | 2.3 | 60 | 22 | 18 | A |
| 9 | F | 2 | GA | 163 | 2.6 | 71 | 20 | 9 | A |
| 10 | F | 4 | GA | 170 | 2.7 | 68 | 25 | 6 | A |
| 11 | F | 5 | GA | 163 | 2.6 | 68 | 24 | 8 | A |
| 12 | G | 2 | GA | 163 | 3.1 | 69 | 23 | 8 | A |
| 13 | A | 7 | GI | 140 | 2.6 | 74 | 17 | 9 | A |
| 14 | A | 8 | GA | 145 | 1.3 | 74 | 15 | 11 | A |
| 15 | B | 7 | GI | 145 | 3.9 | 75 | 19 | 6 | A |
| 16 | C | 9 | GA | 145 | 2.1 | 75 | 16 | 9 | A |
| 17 | D | 12 | GI | 165 | 2.8 | 77 | 11 | 12 | F |
| 18 | E | 10 | none | 214 | 2.4 | 60 | 19 | 20 | F |
| 19 | F | 11 | none | 165 | 2.6 | 80 | 9 | 11 | F |
| 20 | G | 7 | GI | 144 | 2.9 | 73 | 17 | 9 | A |
| 21 | G | 13 | none | 163 | 2.9 | 69 | 30 | 1 | A |
| 22 | H | 2 | GA | 160 | 3.7 | 82 | 8 | 10 | F |
| 23 | J | 4 | GA | 167 | 2.3 | 75 | 15 | 10 | A |
| 24 | K | 3 | GI | 163 | 6.7 | 74 | 19 | 7 | A |
| 25 | L | 1 | GA | 171 | 2.4 | 74 | 18 | 8 | A |
| 26 | M | 5 | GA | 171 | 5.6 | 72 | 17 | 11 | A |
| 27 | N | 6 | none | 219 | 3.7 | 51 | 33 | 16 | A |
| 28 | P | 3 | GI | 217 | 3.7 | 43 | 28 | 28 | F |
| 29 | Q | 4 | GA | 138 | 4.0 | 89 | 7 | 3 | A |

TABLE 3-continued

| Steel sheet No. | Mechanical properties | | | | | | | Ferrite hardness/tensile strength (Hv/MPa) |
|---|---|---|---|---|---|---|---|---|
| | YS (MPa) | TS (MPa) | YR (%) | Elongation EL (%) | Hole expansion ratio λ (%) | TS × EL (MPa. %) | TS × λ (MPa. %) | |
| 1 | 475 | 613 | 77 | 29 | 109 | 17777 | 66817 | 0.28 |
| 2 | 466 | 639 | 73 | 30 | 102 | 19170 | 65178 | 0.26 |
| 3 | 487 | 633 | 77 | 30 | 108 | 18990 | 68364 | 0.27 |
| 4 | 454 | 631 | 72 | 29 | 100 | 18299 | 63100 | 0.27 |
| 5 | 462 | 637 | 73 | 29 | 109 | 18473 | 69433 | 0.25 |
| 6 | 461 | 622 | 74 | 30 | 115 | 18660 | 71530 | 0.26 |
| 7 | 489 | 626 | 78 | 30 | 104 | 18780 | 65104 | 0.27 |
| 8 | 618 | 846 | 73 | 23 | 80 | 19458 | 67680 | 0.26 |
| 9 | 456 | 616 | 74 | 30 | 104 | 18480 | 64064 | 0.26 |
| 10 | 483 | 619 | 78 | 30 | 109 | 18570 | 67471 | 0.27 |
| 11 | 474 | 626 | 76 | 30 | 106 | 18780 | 66356 | 0.26 |
| 12 | 474 | 616 | 77 | 29 | 100 | 17864 | 61600 | 0.26 |
| 13 | 416 | 641 | 65 | 27 | 71 | 17060 | 45511 | 0.22 |
| 14 | 534 | 651 | 82 | 19 | 40 | 12595 | 26040 | 0.22 |
| 15 | 420 | 630 | 67 | 29 | 73 | 18053 | 45990 | 0.23 |
| 16 | 434 | 629 | 69 | 28 | 76 | 17345 | 47804 | 0.23 |
| 17 | 446 | 656 | 68 | 26 | 75 | 16954 | 49200 | 0.25 |
| 18 | 556 | 844 | 66 | 18 | 53 | 14999 | 44732 | 0.25 |
| 19 | 429 | 621 | 69 | 28 | 76 | 17144 | 47196 | 0.27 |
| 20 | 424 | 637 | 67 | 28 | 73 | 17824 | 46501 | 0.23 |
| 21 | 474 | 616 | 77 | 25 | 100 | 15634 | 61600 | 0.26 |
| 22 | 417 | 625 | 67 | 27 | 60 | 16875 | 37500 | 0.26 |
| 23 | 483 | 637 | 76 | 25 | 76 | 15925 | 48412 | 0.26 |
| 24 | 479 | 628 | 76 | 24 | 76 | 15072 | 47728 | 0.26 |
| 25 | 478 | 607 | 79 | 25 | 79 | 15175 | 47953 | 0.28 |
| 26 | 497 | 626 | 79 | 24 | 79 | 15024 | 49454 | 0.27 |
| 27 | 702 | 842 | 83 | 16 | 71 | 13472 | 59782 | 0.26 |
| 28 | 717 | 860 | 83 | 18 | 50 | 15480 | 43000 | 0.25 |
| 29 | 415 | 531 | 78 | 34 | 96 | 18054 | 50976 | 0.26 |

*1"none": no plating, "GI": galvanizing, "GA": galvannealing

*2F: ferrite area fraction, B: bainite area fraction, M: martensite area fraction The steel sheets Nos. 1 to 12 are suitably controlled both in component composition and annealing conditions, thereby have parameters such as ferrite grain size, ferrite hardness/tensile strength of steel sheet, and fractions of respective structures each satisfying requirements herein, and excel both in TS-EL balance and TS-λ balance.

In contrast, the steel sheets Nos. 13 to 21 are samples that do not satisfy requirements in the annealing conditions, and the steel sheets Nos. 22 to 29 are samples that do not satisfy requirements in the component composition.

More specifically, the steel sheets Nos. 13, 15, and 20 are samples which have decreased ferrite hardness due to a lower average heating rate (HR) to the soaking temperature (T1), and this enlarges the difference in hardness between ferrite and the second phase structure and thereby impair the TS-λ balance.

The steel sheet No. 14 is a sample that has a remained worked structure in its structure due to the low soaking temperature (T1), and this makes the ferrite grain size excessively small to thereby cause an excessively high yield strength, resulting in impaired TS-EL balance. This sample also has impaired TS-λ balance, because manganese (Mn) and niobium (Nb) have not been sufficiently re-dissolved.

The steel sheet No. 16 has impaired TS-λ balance, because austenization has not sufficiently proceeded and manganese and niobium have not been sufficiently re-dissolved due to a short soaking time (t1), the ferrite structure thereby has a decreased hardness, and the difference in hardness between ferrite and the second phase structure becomes large.

The steel sheet No. 17 is a sample that has impaired TS-λ balance, because bainite transformation has not sufficiently proceeded due to a short residence time (t3) in the temperature range of from 400° C. to 600° C., and the condition that the bainite area fraction B is larger than the martensite area fraction M is not satisfied.

The steel sheet No. 18 is a sample that has impaired TS-λ balance, because bainite transformation has not sufficiently proceeded due to an excessively high holding temperature (T2) and the steel sheet thereby has a bainite fraction smaller than a martensite fraction (B<M).

The steel sheet No. 19 is a sample that has impaired TS-λ balance, because bainite transformation has not sufficiently proceeded due to an excessively low holding temperature (T2) and the steel sheet thereby has a low bainite fraction smaller than a martensite fraction (B<M).

The steel sheet No. 21 is a sample that has impaired TS-EL balance, because martensite is not sufficiently formed due to an excessively long residence time (t3) in the temperature range of from 400° C. to 600° C.

The steel sheet No. 22 is a sample that has impaired TS-λ balance, because bainite transformation is suppressed to give a low bainite fraction due to an excessive high Si content of Steel H used therein.

The steel sheets Nos. 23 and 25 have impaired TS-λ balance, because they have an excessively high content of Ti or Nb to cause the generation of coarse carbides and/or nitrides of Ti or Nb to thereby cause rupture in early stages.

The steel sheets Nos. 24 and 26 are samples that have an excessively low content of Ti or Nb and have impaired TS-EL balance, because formation of carbides of Ti or Nb is too small to exhibit their pinning effects, and this causes ferrite grains to be coarse.

The steel sheet No. 27 is a sample that has an excessively high carbon content to cause an excessively high bainite fraction, resulting in impaired TS-EL balance.

The steel sheet No. 28 is a sample that has impaired TS-EL balance, because it has an excessively high Mn content, thereby has a small ferrite fraction and in contrast has an excessively large martensite fraction.

The steel sheet No. 29 is a sample that has an excessively low carbon content and is inferior both in TS-EL balance and TS-λ balance, because the material steel has a low strength due to the low carbon content, thereby has a low ferrite hardness, and generation of bainite and martensite is not accelerated, and the ferrite fraction becomes excessively large.

What is claimed is:

1. A steel sheet comprising:

0.03 to 0.13 percent by mass of carbon (C), 0.02 to 0.8 percent by mass of silicon (Si), 1.0 to 2.5 percent by mass of manganese (Mn), 0.03 percent by mass or less of phosphorus (P), 0.01 percent by mass or less of sulfur (S), 0.01 to 0.1 percent by mass of aluminum (Al), 0.01 percent by mass or less of nitrogen (N), and at least one member selected from the group consisting of 0.004 to 0.1 percent by mass of titanium (Ti) and 0.004 to 0.07 percent by mass of niobium (Nb), with the remainder including iron and inevitable impurities, wherein the steel sheet structurally has a ferrite matrix structure and bainitic and martensitic second phase structures, the steel sheet has a ferrite fraction of from 50 to 86 percent by area, a bainite fraction of from 10 to 30 percent by area, and a martensite fraction of from 4 to 20 percent by area based on the entire structure, wherein the bainite area fraction is larger than the martensite area fraction, and wherein the ferrite has an average grain size of 2.0 to 5.0 μm, and the ratio of the average hardness (Hv) of the ferrite to the tensile strength (MPa) of the steel sheet is equal to or more than 0.25.

2. The steel sheet according to claim 1, further comprising at least one member selected from the group consisting of 0.01 to 1 percent by mass of chromium (Cr) and 0.01 to 0.5 percent by mass of molybdenum (Mo).

3. The steel sheet according to claim 1, further comprising 0.0001 to 0.003 percent by mass of boron (B).

4. The steel sheet according to claim 1, further comprising 0.0005 to 0.003 percent by mass of calcium (Ca).

5. The steel sheet according to claim 1, which is a galvanized steel sheet.

6. The steel sheet according to claim 1, which is a galvannealed steel sheet.

7. A method for producing the steel sheet of claim 1, the method comprising:

preparing a cold-rolled steel sheet, wherein the cold rolled steel sheet has a chemical composition comprising 0.03 to 0.13 percent by mass of C, 0.02 to 0.8 percent by mass of Si, 1.0 to 2.5 percent by mass of Mn, 0.03 percent by mass or less of P, 0.01 percent by mass or less of S, 0.01 to 0.1 percent by mass of Al, 0.01 percent by mass or less of N, and at least one member of 0.004 to 0.1 percent by mass of Ti and 0.004 to 0.07 percent by mass of Nb, with the remainder including iron and inevitable impurities; and annealing the cold-rolled steel sheet, wherein the annealing sequentially includes heating the cold-rolled steel sheet to a temperature range (Ti) equal to or higher than the $Ac_3$ point at an average heating rate of 5° C./s or more, holding the heated steel sheet in the temperature range (T1) for 10 to 300 seconds, cooling the steel sheet from the temperature range (T1) to a temperature range (T2) of from 400° C. to 600° C. at an average cooling rate of 2° C./s or more, holding the cooled steel sheet in the temperature range (T2) of from 400° C. to 600° C., and cooling the steel sheet, wherein the steel sheet is in the temperature range of from 400° C. to 600° C. for a residence time (t3) of from 40 to 400 seconds in the annealing.

* * * * *